US006845814B2

(12) United States Patent
Mason et al.

(10) Patent No.: US 6,845,814 B2
(45) Date of Patent: Jan. 25, 2005

(54) PIPE-GRIPPING STRUCTURE HAVING LOAD RINGS

(75) Inventors: David Mason, Anaheim Hills, CA (US); Albert De Pont, Dongen (NL); Hans Van Rijzingen, Oosterhout (NL); Anton Krijnen, Klundert (NL); Cornelis De Laat, Etten-Leur (NL)

(73) Assignee: Varco I/P, Inc., Orange, CA (US)

( * ) Notice: Subject to any disclaimer, the term of this patent is extended or adjusted under 35 U.S.C. 154(b) by 8 days.

(21) Appl. No.: 10/336,084

(22) Filed: Jan. 3, 2003

(65) Prior Publication Data

US 2003/0173117 A1 Sep. 18, 2003

Related U.S. Application Data

(60) Provisional application No. 60/345,226, filed on Jan. 4, 2002.

(51) Int. Cl.[7] ..... E21B 19/10; E21B 19/02

(52) U.S. Cl. ..... 166/75.14; 166/77.53; 175/423; 294/902

(58) Field of Search ..... 166/77.53, 75.14; 175/423; 188/67; 294/902, 102.1, 102.2

(56) References Cited

U.S. PATENT DOCUMENTS 1,414,951 A 5/1922 Hosmer et al.
1,659,639 A 2/1928 Smith
1,795,578 A 3/1931 Smith
1,889,592 A 11/1932 Brandt
2,071,637 A 2/1937 Laurent
2,143,615 A 1/1939 Abegg
2,143,849 A 1/1939 Gordy, Jr.
2,144,146 A 1/1939 Driscoll
2,156,384 A 5/1939 Fluellen
2,245,979 A 6/1941 Johnson
2,282,758 A 5/1942 Gallagher (List continued on next page.)

OTHER PUBLICATIONS

International Search Report for International Application No. PCT/US03/00230; 3pp.

*Primary Examiner*—David Bagnell
*Assistant Examiner*—T. Shane Bomar
(74) *Attorney, Agent, or Firm*—Christie, Parker & Hale, LLP

(57) ABSTRACT

A rotary slip for supporting a drill string having a plurality of slip segments connected to define an opening for insertion of the drill string, wherein each slip segment comprises a head region, a toe region, and an inner radial surface axially extending between the head and toe regions, and wherein the inner radial surface of each slip segment comprises a circumferential groove. A plurality of axially aligned drill string gripping inserts are attached to each slip segment between the head region and the circumferential groove, wherein each insert comprises a gripping surface for contacting the drill string. A load ring is disposed within the circumferential groove of each slip element, the load ring comprising at least one securing element which is engaged by one of the plurality of axially aligned inserts to secure the load ring within the circumferential groove.

22 Claims, 9 Drawing Sheets

U.S. PATENT DOCUMENTS

| | | | | |
|---|---|---|---|---|
| 2,287,432 | A | | 6/1942 | Kinzbach |
| 2,575,649 | A | | 11/1951 | Abegg |
| 2,612,671 | A | | 10/1952 | Martin |
| 2,785,454 | A | | 3/1957 | Young |
| 2,810,551 | A | | 10/1957 | Long |
| 2,814,087 | A | | 11/1957 | Palmer |
| 2,814,461 | A | | 11/1957 | Martin |
| 2,874,436 | A | | 2/1959 | Allen |
| 2,890,513 | A | | 6/1959 | Lane |
| 3,017,936 | A | | 1/1962 | Long |
| 3,052,943 | A | | 9/1962 | Jones |
| 3,140,523 | A | | 7/1964 | Taylor, Jr. |
| 3,149,391 | A | | 9/1964 | Boster |
| 3,268,969 | A | | 8/1966 | Turner, Jr. |
| 3,349,455 | A | | 10/1967 | Doherty |
| 3,353,235 | A | | 11/1967 | Adams |
| 3,358,341 | A | | 12/1967 | Burstall |
| 3,365,762 | A | | 1/1968 | Spiri |
| 3,571,865 | A | | 3/1971 | Johnson |
| 3,579,752 | A | | 5/1971 | Brown |
| 3,742,563 | A | | 7/1973 | Brown |
| 3,748,702 | A | | 7/1973 | Brown |
| 3,846,877 | A | | 11/1974 | Spiri |
| 4,269,277 | A | | 5/1981 | Baugh |
| 4,355,443 | A | | 10/1982 | Blackwell |
| 4,511,168 | A | | 4/1985 | Haynes |
| 4,681,193 | A | | 7/1987 | Crowe |
| 4,715,456 | A | | 12/1987 | Poe, Jr. et al. |
| 4,823,919 | A | | 4/1989 | Hayatdavoudi |
| 5,451,084 | A | | 9/1995 | Jansch |
| 5,732,772 | A | * | 3/1998 | Borak et al. ..... 166/75.14 |
| 5,848,647 | A | | 12/1998 | Webre et al. |
| 5,992,801 | A | | 11/1999 | Torres |
| 6,264,395 | B1 | | 7/2001 | Allamon et al. |
| 6,471,439 | B2 | | 10/2002 | Allamon et al. |
| 6,557,641 | B2 | * | 5/2003 | Sipose et al. ..... 166/380 |

* cited by examiner

PIPE-GRIPPING STRUCTURE HAVING LOAD RINGS

CROSS-REFERENCE TO RELATED APPLICATION(S)

This application claims priority under 35 U.S.C. §119(e) to U.S. Provisional Patent Application Ser. No. 60/345,226, filed on Jan. 4, 2002.

FIELD OF THE INVENTION

This invention relates to an improved pipe-gripping structure and method of manufacturing a pipe-gripping structure, and more particularly, to a method of installing load rings within a slip assembly to provide a pipe-gripping structure having improved load lift properties.

BACKGROUND

In the oilfield, when drilling for oil or gas, a platform is used to support a circular rotary table. Rotational energy is supplied to the rotary table through motors or the like, moving the rotary table in a circular fashion. The rotary table comprises a central kelly bushing which provides a central opening or bore through which a drill string passes. The kelly bushing typically provides four "pin holes" receptive of pins on a master bushing which when interlocked with the kelly bushing, drive a kelly held therein. The rotary table, kelly, master bushing and kelly bushing are art terms referring to the various parts of the drilling rig which actually impart the needed rotational force to the drill string to effect drilling. Such well drilling equipment is known in the art.

When adding or removing a joint of pipe from the drill string, wedges called "slips" are inserted into a bowl, called a slip bowl, in the central opening of the rotary table. The slips hold the drill pipe to prevent it from falling into the well bore. The placement of the slips may be manual, in which case the slips are provided with handles for gripping and lifting by well personnel, often referred to as "roughnecks." In other cases the slips may be moved into position using a powered mechanical or hydraulic system. Once the pipe is securely held by the slips, additional sections of pipe can be added to/or removed from the drill string.

In some instances, slips comprise two arcuate slip segments hinged on either side of a center arcuate slip segment to form an orifice through which the drill string extends. Each slip segment has an inner surface comprising a plurality of axially milled grooves for receiving a series of vertically stacked gripping elements or inserts. The inserts have roughened surfaces which extend towards and grip the drill string when the slip is engaged with the pipe.

In most slips, the axial grooves are of dovetail cross-section and are machined from the top down to a lower toe area of the slip by a dovetail cutter. The dovetail cutter is circular in shape and as the cutter is milled down to the bottom of the casting, the cutter leaves a radius at the bottom of the dovetail groove. Such a radius experiences high stress concentrations as the axial or "hook" loads of the pipe are transferred through the inserts to the terminal ends of the dovetail grooves. These high stress concentrations often result in deformation or failure of the bottom toe area of the slip segments.

One solution to the high stress caused by the radius at the bottom of the dovetail groove, is to provide a circumferential relief groove for the cutter to pass through at the bottom shoulder of the slip segments such that the radius is eliminated. Half-moon inserts or load supporting rings are then inserted into the relief grooves to provide the dovetail groove a squared terminal end and a flat support surface for the inserts installed along the bottom shoulder. However, because of the large axial loads transferred through the inserts or load rings to the bottom shoulder, many of these inserts or load rings are either pushed out or must be hardened and welded in place to become a more permanent part of the bottom casting.

Although these permanent load supporting devices may improve the performance of the slip, damage to the load supporting devices may require replacement of the entire slip segment. Damage to these load supporting devices may occur due to a variety of reasons. For example, if a slip is used to hold a drilling string large enough to create axial loads close to the slip's rated limit, any additional force caused by the movement of the rig will cause the inserts to jam and overload the load ring. In such instances, the load ring needs to be replaced. If the load ring is permanently welded to the bottom casing, then the entire slip would need to be replaced. Accordingly, it is important that the load rings be removable because they wear and can be overloaded.

In response to the foregoing problems, removable load rings have been developed, such as those manufactured and sold by Varco International, Inc., Orange, Calif. 92868. Specifically, these load rings have been used with slip segments (Part No. 70102-1) for Varco's 1,000 ton elevator spider (Part No. 70100). These load rings are generally semi-circular and installed in relief grooves centrally disposed along the axial dovetail grooves and along the slip's bottom shoulder. These load rings are typically fastened in place by bolts.

Other removable load rings include the type described in U.S. Pat. No. 6,264,395 (the '395 Patent). In an attempt to improve then existing slip assemblies, the '395 patent discloses a slip assembly having slip segments with circumferential grooves cut at reverse angles. The circumferential grooves are adapted to receive complementary shaped surfaces of a load ring to prevent upward slippage of the load ring during loading. The load ring is secured within the grooves by bolts disposed at spaced intervals along the load ring.

While existing removable load rings have been helpful in addressing the problems associated with permanently coupled inserts, the fasteners used to secure these load rings, such as threaded bolts or cotter pins, may provide additional problems. For example, the aforementioned fasteners may become loosened or fail under extreme axial loads and fall into the well bore.

Accordingly, there is a need for a load ring that is removable and easy to install. It is desirable that such a load ring not be secured by fasteners or other means that might loosen and potentially fall into the well bore.

SUMMARY OF THE INVENTION

An exemplary embodiment of the present invention includes a rotary slip for supporting a drill string comprising a plurality of slip segments connected to define an opening for insertion of the drill string, wherein each slip segment comprises a head region, a toe region, and an inner radial surface axially extending between the head and toe regions, and wherein the inner radial surface of each slip segment comprises a circumferential groove. A plurality of axially aligned drill string gripping inserts are attached to each slip segment between the head region and the circumferential groove, wherein each insert comprises a gripping surface for contacting the drill string. A load ring is disposed within the circumferential groove of each slip element, the load ring comprising at least one securing element which is engaged by one of the plurality of axially aligned inserts to secure the load ring within the circumferential groove.

In another embodiment of the present invention, the inner radial surface of each slip segment of the above described rotary slip comprises at least one axial groove extending from the head region to the circumferential groove, such that each axial groove extends into the circumferential groove.

In another embodiment of the present invention, the circumferential groove comprises a upper, lower and inner surfaces and the load ring comprises inner, outer, top and lower surfaces, such that the lower, outer and top surfaces of the load ring fit, respectively, within the lower, inner and upper surfaces of the circumferential groove. In addition, at least one tab protrudes from the top surface of the load ring, wherein each tab comprises a front surface and a back surface, such that the front surface of each tab is engaged by one of the plurality of axially aligned inserts to secure the load ring within the circumferential groove.

BRIEF DESCRIPTION OF THE DRAWINGS

These and other features and advantages of the present invention will be better understood by reference to the following detailed description when considered in conjunction with the accompanying drawings wherein.

DETAILED DESCRIPTION

Figure 1:
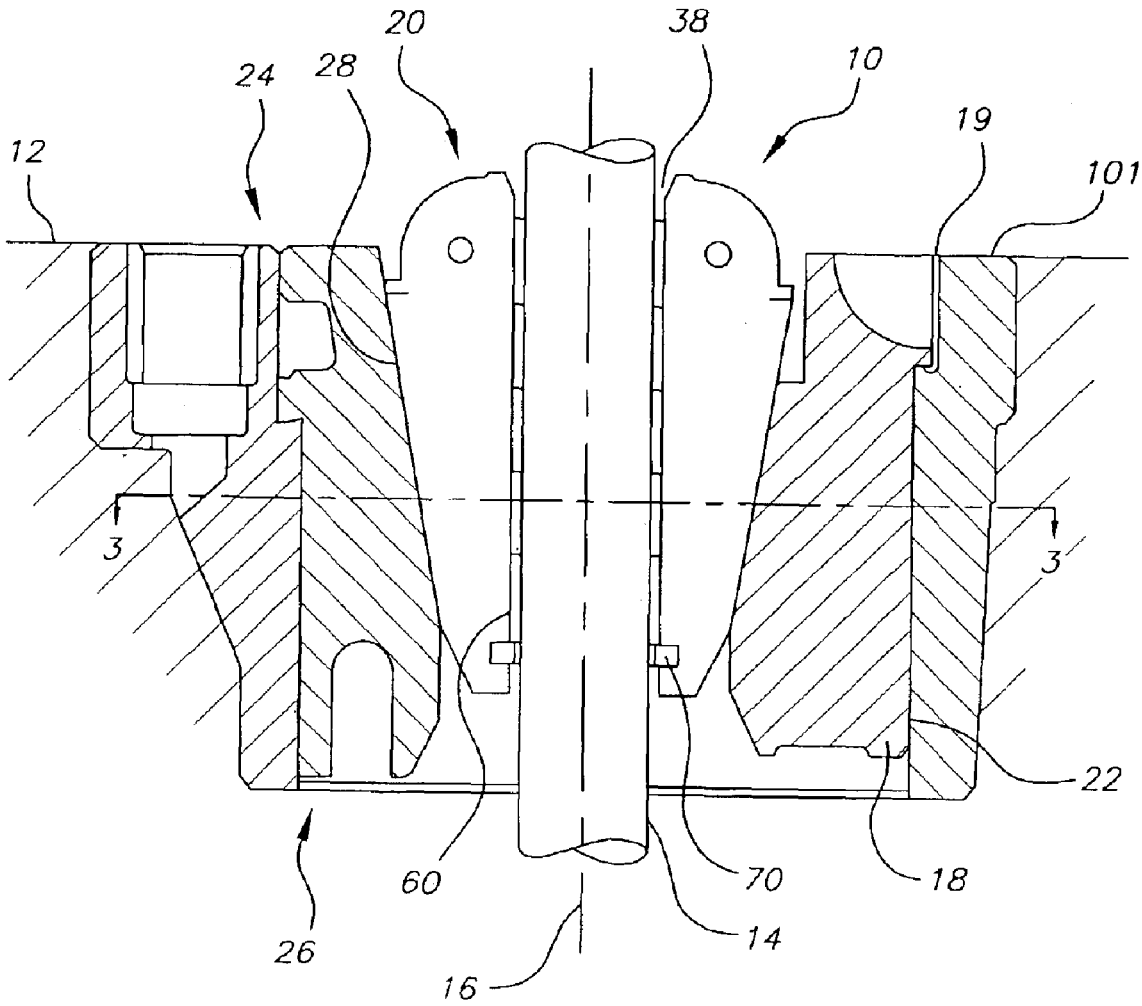
FIG. 1 is a partial schematic cross-sectional view of a manual slip system in accordance with the present invention mounted onto a rotary table.

FIG. 1 illustrates a conventional rotary table 12 for suspending a pipe or drill string 14 directly above a well bore and for rotating the drill string about a vertical axis 16. The table 12 includes a manual slip system 10 according to the present invention. The system includes a slip bowl 18, which is mounted within a central opening 19 of the master bushing 101 and a rotary slip assembly 20, which is rotatably disposed within the slip bowl 18. The slip bowl 18 is defined by a cylindrical outer wall 22 that extends axially between an upper "head" region 24 and a lower "toe" region 26, and a tapered inner wall 28 having a reduced diameter at the toe region.

The slip assembly 20 generally comprises a plurality of slip segments having tapered outer walls that are adapted to engage the tapered inner wall 28 of the bowl 18 to retain the slip assembly 20 from lateral, but not rotational movement within the bowl 18. Each slip segment carries along its inner surface a series of inserts 60 which grip the drill string 14 to prevent the drill string 14 from falling into the well bore, and at least one circumferential groove 70. In one embodiment, the circumferential groove 70 is disposed within the toe region 26 of each slip segment. In the present invention, as shown in FIG. 7, a load ring 90 is adapted to be received by the circumferential groove 70 to absorb the axial or "hook" loads imposed on the inserts 60 during operation. Although one embodiment of a slip is shown in the above referenced figures, it should be understood that the number of slip assemblies, slip segments, and inserts may vary.

Figure 2:
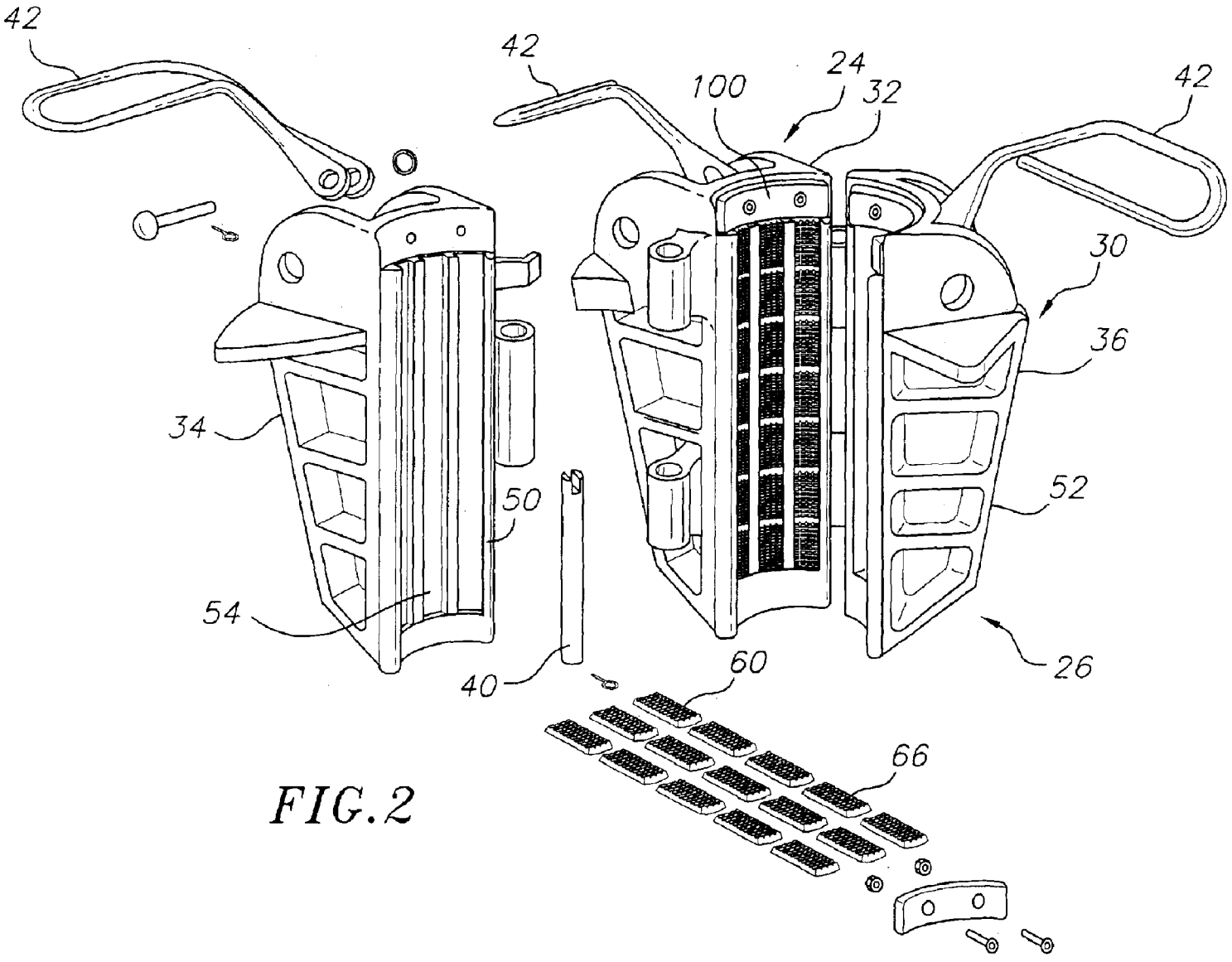
FIG. 2 is an exploded perspective view of the slip system of FIG. 1.

Referring to FIG. 2, in the depicted embodiment, the slip assembly 20 comprises a generally annular body 30 formed by a center slip segment 32, a left hand segment slip 34 and a right hand slip segment 36. The slip segments are symmetrically disposed about the vertical axis 16 and form an orifice 38, as shown in FIG. 1, for receiving the drill string 14. Although the embodiment shown in FIG. 2 depicts a slip assembly comprising three slip segments, it should be understood that the number of slip segments in each slip assembly may vary.

The left and right hand slip segments 34 and 36 are hinged on opposite sides of the center slip segment 32 by a pair of hinge pins 40. Each slip segment also includes a manual handle 42 coupled to the head of the segments to allow the operators to lift or hoist the slip assembly 20 out of engagement with the slip bowl 18.

Each slip segment has an arcuate body shape defined by an interior surface 50 and a downwardly tapered outer wall 52. In one embodiment, the slip segments are cast from CMS 02 grade 150-135 steel, or CMS 01 steel. In an exemplary embodiment, a series of axial grooves 54 are milled lengthwise along the interior surface 50 of the slip segments. The axial grooves 54 extend from the head region 24 of the slip segments and terminate at the toe region 26 of the slip segments at the top of the circumferential groove 70 (as shown in detail in FIG. 4).

Figure 3A:
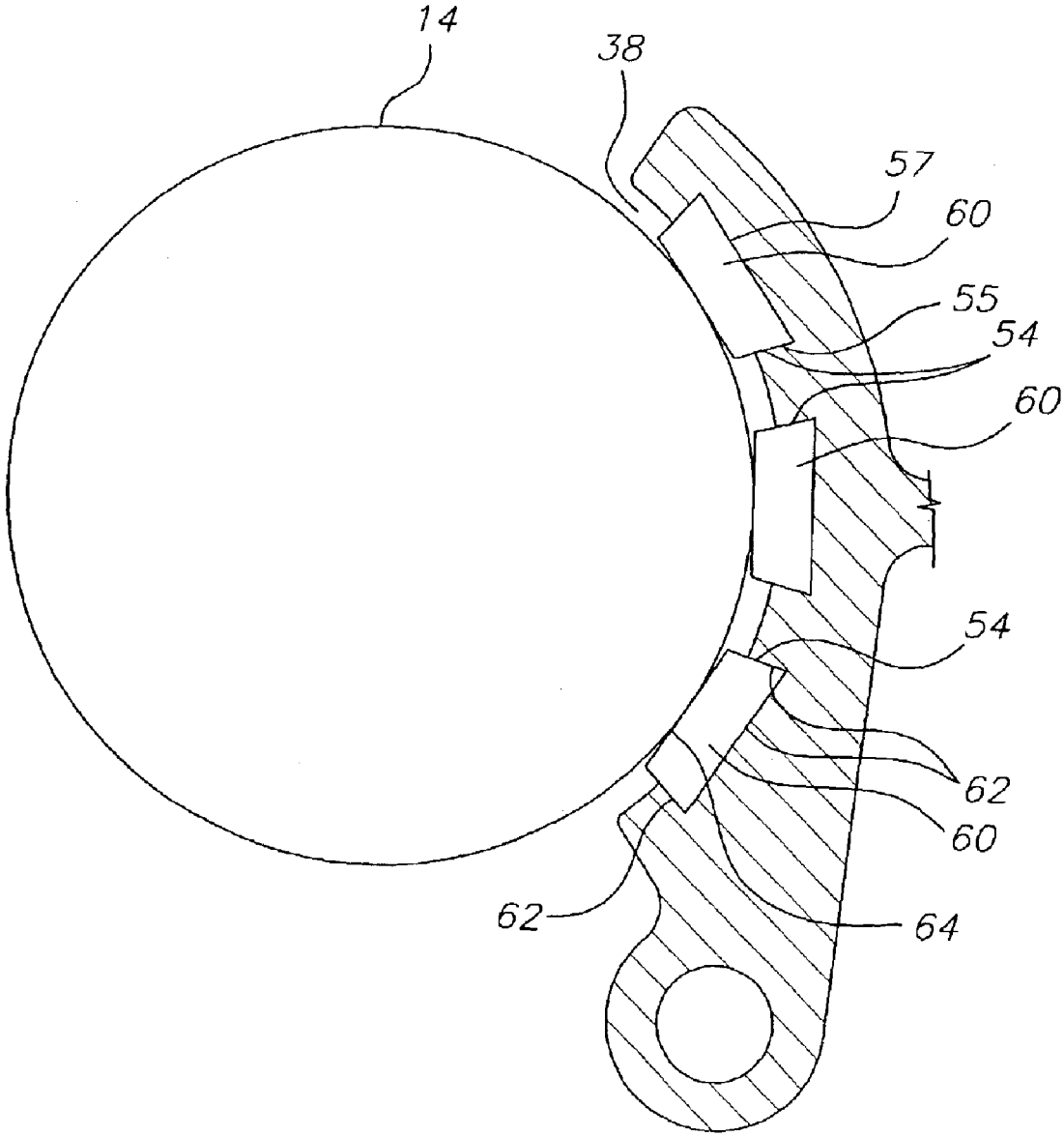
FIG. 3A is a partial horizontal cross-sectional taken along the line 3—3 of FIG. 1, in combination with a drill pipe shown in outline form.
Figure 3B:
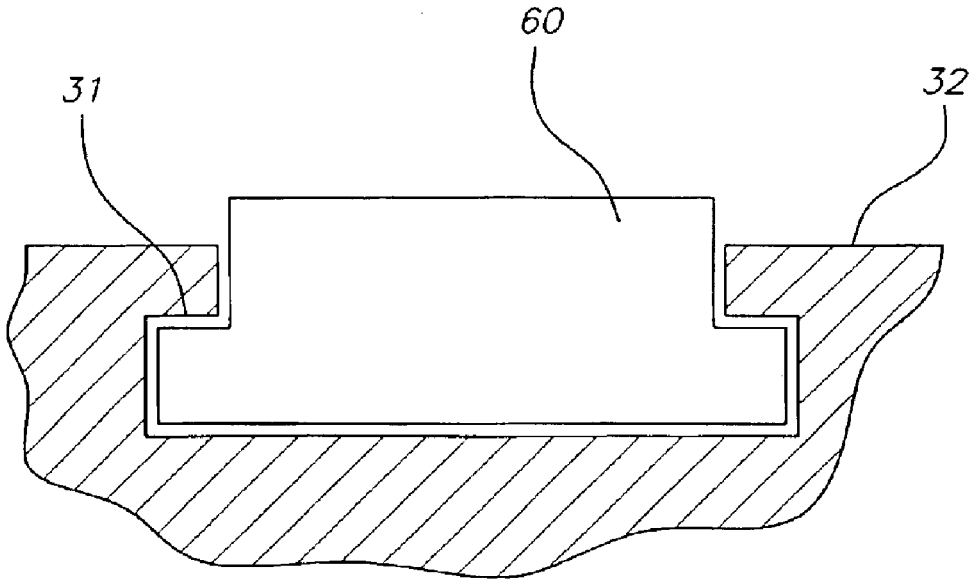
FIGS. 3B and 3C are partial cross-sectional views of a slip segment of the present invention having an insert disposed therein.
Figure 3C:
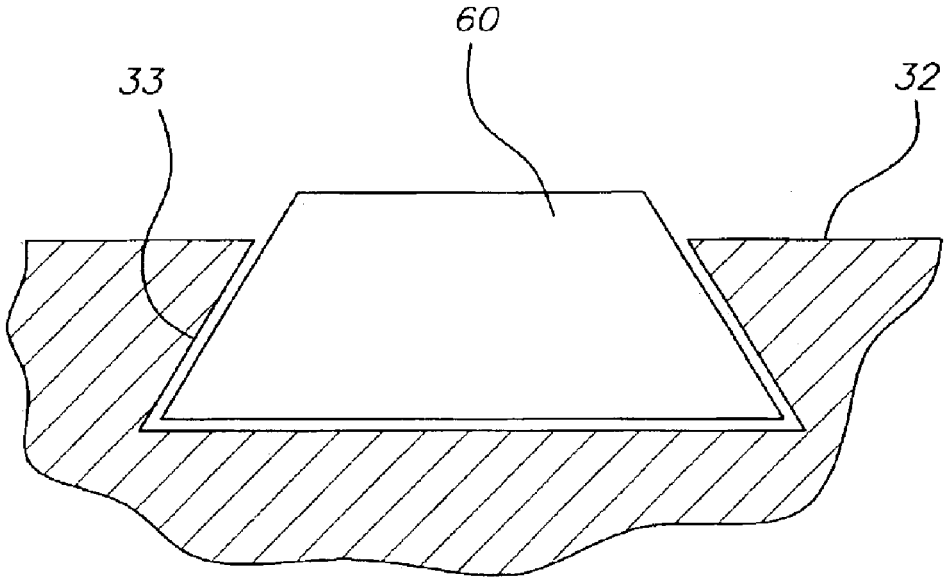

As shown in FIG. 3, the axial grooves 54 comprise an inner surface 57 and spaced apart sidewalls 55, which combine to form a cross-section that is adapted to receive and interlockingly engage a series of the inserts 60. Any cross-section suitable for interlockingly engaging the inserts 60 to retain the inserts 60 within the grooves 54 may be utilized, such as, for example, a T-shaped cross-section 31 (as shown in FIG. 3B), a partial trapezoidal cross-section 33 (as shown in FIG. 3C) or a dove tailed cross-section. In one embodiment, the sidewalls 55 of the axial grooves 54 are angled or tapered to form the partial trapezoidal cross-section 33 and the inserts 60 are trapezoidal in shape, such that when the inserts 60 are placed within the axial grooves 54, the angled side surfaces of the inserts 60 are interlockingly engaged with the angled sidewalls 55 of the axial grooves 54.

As is also shown in FIG. 3, a series of the inserts 60 is received by the axial grooves 54. Each insert 60 includes contact surfaces 62 that form a cross-section corresponding to the cross-section of the groove 54. Each insert 60 also includes a gripping surface 64. In one embodiment, the contact surfaces 62 are retained within the axial grooves 54 and the gripping surfaces 64 extend out of the axial grooves 54 and into the orifice 38. The gripping surfaces 64 comprise gripping elements 66 (as shown in FIG. 2), which effectively grip and support the drill string 14 when the drill string 14 is engaged by the slip. In one embodiment, the inserts 60 are vertically stacked within the axial grooves 54 in sets of five, but the number of inserts 60 stacked within the axial grooves 54 may vary based on considerations such as the outer diameter, the wall thickness, and the material strength of the drill string 14 that is being supported. In one embodiment, for example, the inserts 60 are formed from carburized 8620 low alloy steel.

Figure 4:
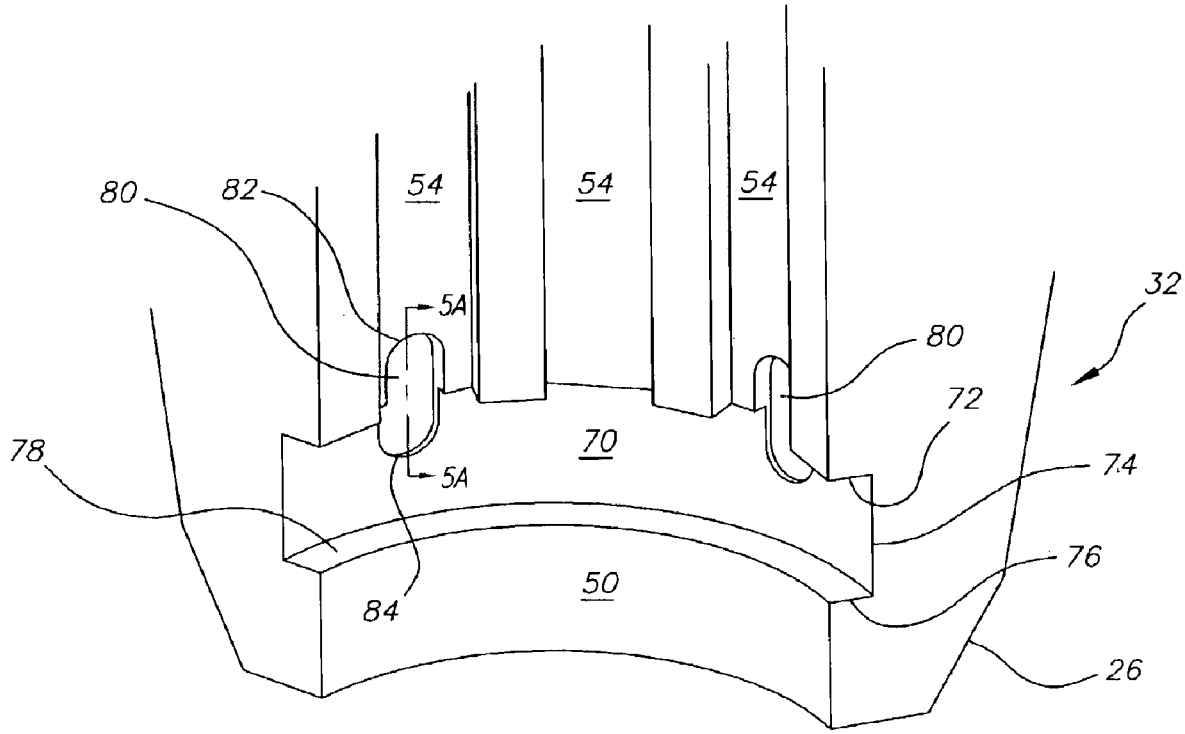
FIG. 4 is a partial perspective view of a toe area of a slip segment in accordance with the present invention.
Figure 5A:
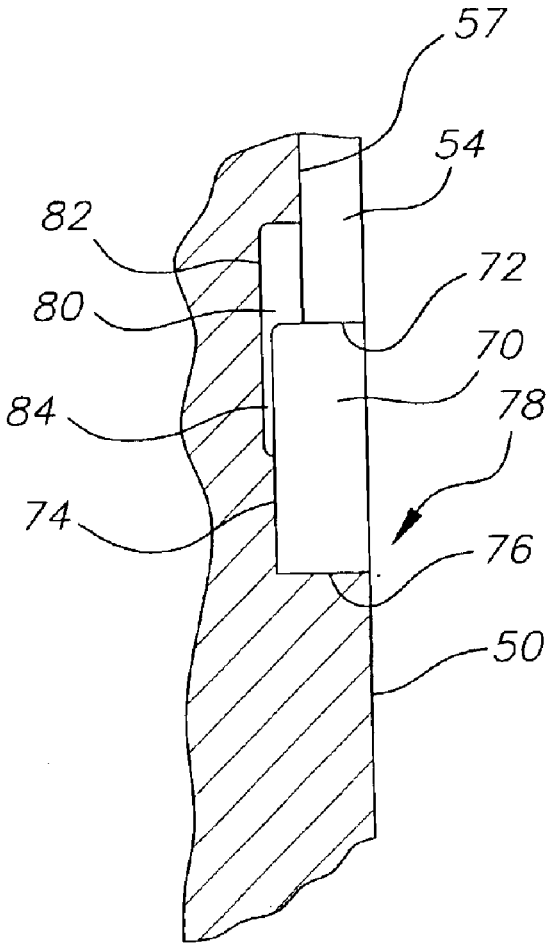
FIG. 5A is a partial vertical sectional view taken along the line 5—5 of FIG. 4.
Figure 5B:
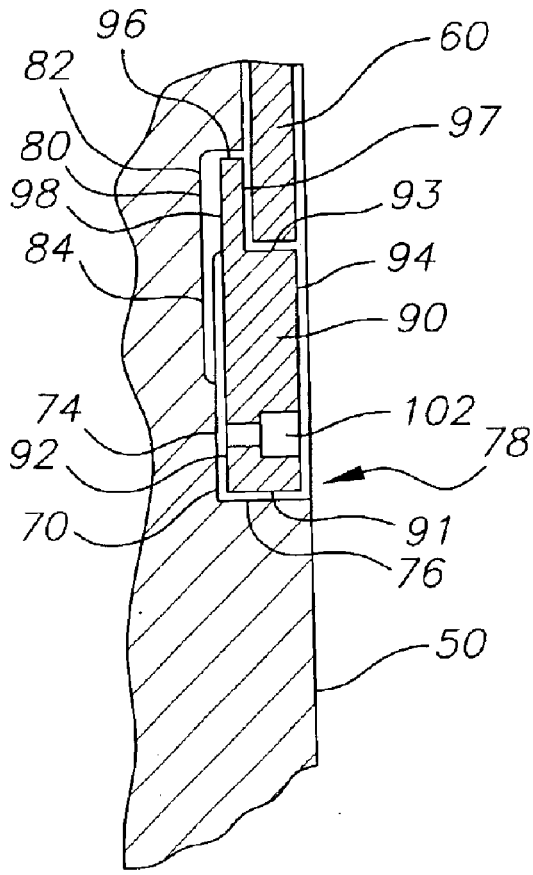
FIG. 5B is the partial vertical sectional view of FIG. 5A having a load ring and an insert adjacent to a slig segment.
Figure 6B:
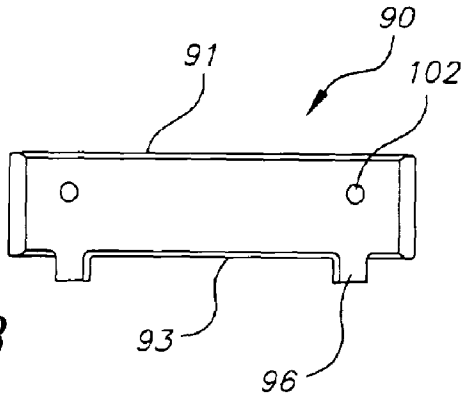
FIG. 6B is a back view of a load ring in accordance with the present invention.

With reference to FIGS. 4 and 5A–5B, the circumferential groove 70 is formed by milling or otherwise cutting into the interior surface 50 of the slip segments at the toe region 26. The circumferential groove 70 receives the load ring 90, described below. The circumferential groove 70 is defined by an upper surface 72 that forms the terminal end of the axial grooves 54, an inner surface 74, and a lower surface 76, which forms a shoulder 78 with the interior surface 50. Oblong notches 80 are distributed along the upper surface 72 of the circumferential groove 70 to receive securing elements 96 (as shown in FIG. 6B) that are coupled to the load ring 90. The notches 80 are disposed about the upper surface 72 at locations corresponding with the axial grooves 54. Each notch 80 is positioned about the upper surface 72 such that a top portion 82 of the notch 80 is recessed into a corresponding axial groove 54 and a lower portion of the notch 84 is recessed into the inner surface 74 of the circumferential groove 70.

Figure 6C:
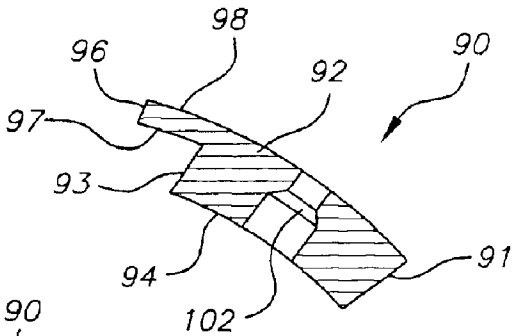
FIG. 6C is a cross-sectional view taken along the line 6C—6C of FIG. 6.
Figure 6A:
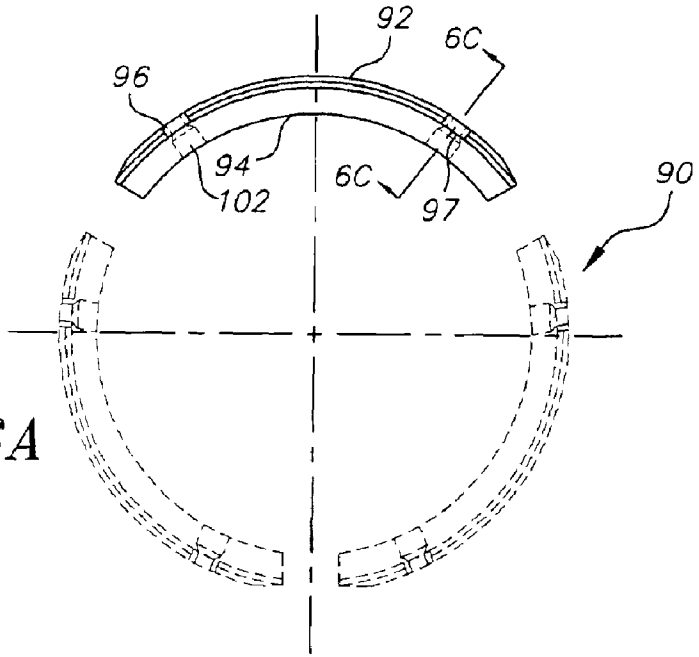
FIG. 6A is a top view of a set of load rings in accordance with the present invention.

As shown in FIGS. 6A to 6C, each load ring 90 comprises a substantially 120° arcuate segment having dimensions such that each load ring 90 fits securely within the circumferential groove 70. The load ring 90 is defined by a lower surface 91 that engages the shoulder 78, an outer surface 92 that engages the inner wall 74 of the groove, a top surface 93 that engages the upper surface 72 of the groove, and an inner surface 94 mounted flush to the interior surface 50 of the slip segment. In one embodiment, the load ring 90 is machined from a wrought metal, such as 40 series steel, 4141 or 4340, and hardened through a heat treatment process to a tensile strength of about 170 kips to about 175 kips.

Extending upwardly from the top surface 93 and outwardly from the outer surface 92 are the securing elements or tabs 96 disposed at locations along the load ring 90 that correspond to the notches 80 in the slip segment. The tabs 96 are formed to a shape corresponding with the notches 80 such that the tabs 96 fully engage the notches 80 when the load ring 90 is installed within the circumferential groove 70. Each tab 96 is appropriately formed such that when a back face 98 of the tab 96 is received within the notch 80, a front face 97 of the tab 96 is flush with the an inner surface 57 of the axial groove 54. Thus, the inserts 60 are able to slide within the axial grooves 54, over the front face 97 of the tabs 96 to engage a top surface 93 of the load ring 90, such that when one of the inserts 60 engages the load ring 90, it engages the front face 97 of the tabs 96 and the top surface 93 of the load ring 90 to retain the load ring 90 within the circumferential groove 70. In one embodiment, the tabs 96 and the corresponding notches 80 are "tightly toleranced" to allow the tabs 96 to "snugly" fit within the notches 80. In one embodiment, the tabs 96 and notches 80 have curved edges.

The present invention provides a removable load ring 90 which is advantageous over inserts or rings of the prior art. The load ring 90 of the present invention is not required to be hardened and welded in place during installation. It is important that the load rings be removable because they wear and can be overloaded during operation. Further, the load ring 90 of the present invention does not require any threaded bolts to secure the load ring 90 within the circumferential groove 70. This is advantageous because it alleviates the possibility of bolts "backing out" or disengaging during operation and falling down the well bore.

The load ring 90 is installed into each slip segment by first placing it within the circumferential groove 70 such that the load ring tabs 96 are fully engaged with the slip segment notches 80. Next, the inserts 60 are vertically stacked within the slip segment axial grooves 54. The first of the vertically stacked inserts 60 engages the load ring 90 to secure the load ring 90 within the circumferential groove 70. Once the inserts 60 are stacked within the axial grooves 54, a retainer ring 100 (FIG. 2), which sits within a shoulder located at the head of the slip segment, is used to retain the stacked inserts in place. The retainer ring is secured to the head region of the slip segments by threaded bolts.

During operation, the axial or hook loads exerted from the drill string 14 to the inserts 60 act to further engage secure the inserts 60 against the load ring 90. The load ring 90 functions to absorb the axial and hook loads and distribute them uniformly about the shoulder 78 of the circumferential groove 70. Thus, the axial and hook loads are uniformly distributed about the shoulder 78 of the circumferential groove 70 and are not concentrated at the terminal ends of the grooves 54. This uniform distribution of the load reduces the chance of deformation or failure about the toe region of the slip segments due to excessive axial or hook loads.

Figure 7B:
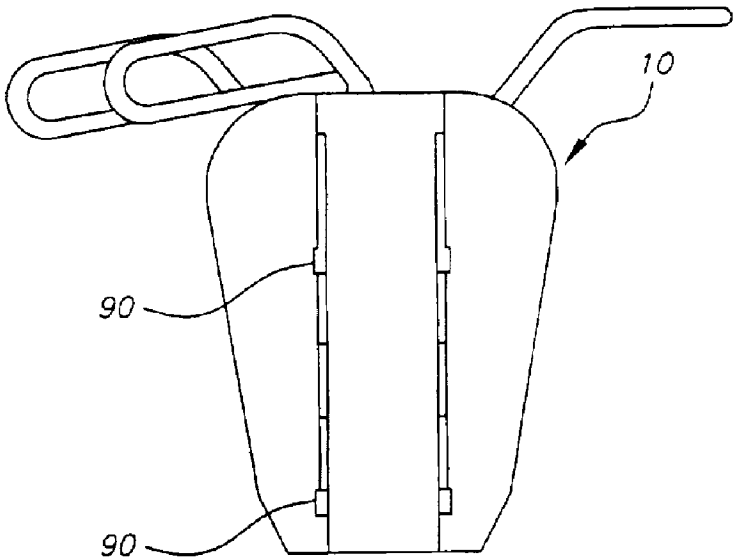
FIG. 7B is a cross-sectional view of the manual rotary slip of FIG. 7A.
Figure 7A:
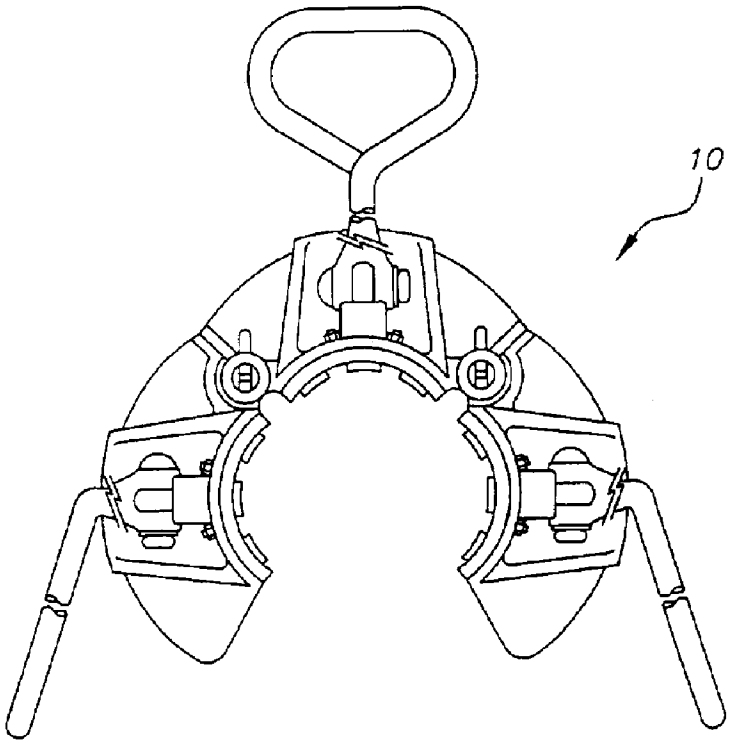
FIG. 7A is a top view of a manual rotary slip in accordance with the present invention, wherein the slip is in a partially opened position.

While only one load ring 90 per slip segment is described in the embodiments above, any number of load rings may be used to change the distribution of the load carried by the inserts 60. For example, as shown in FIGS. 7A and 7B, a second load ring 90' may be used in a central region of each slip segment. Such a configuration may change the axial or hook load distribution along the length of the slip such that about 60% of the compressive load is carried by the load ring 90 at the toe region and about 40% of the compressive load is carried by the second load ring 90' at the central region. In one embodiment, slips rated at about 350 tons to about 500 tons may utilize one load ring 90 and slips rated at about 750 tons or higher may utilize at least the load ring 90 and the second load ring 90'.

In alternative embodiments, additional fasteners may be used to secure the load ring 90 within the circumferential groove 70, such as cotter pins or threaded bolts, as shown in FIGS. 6A to 6C. For example, each slip segment may comprise one or more openings 102 for receiving cotter pins or threaded bolts.

Figure 8:
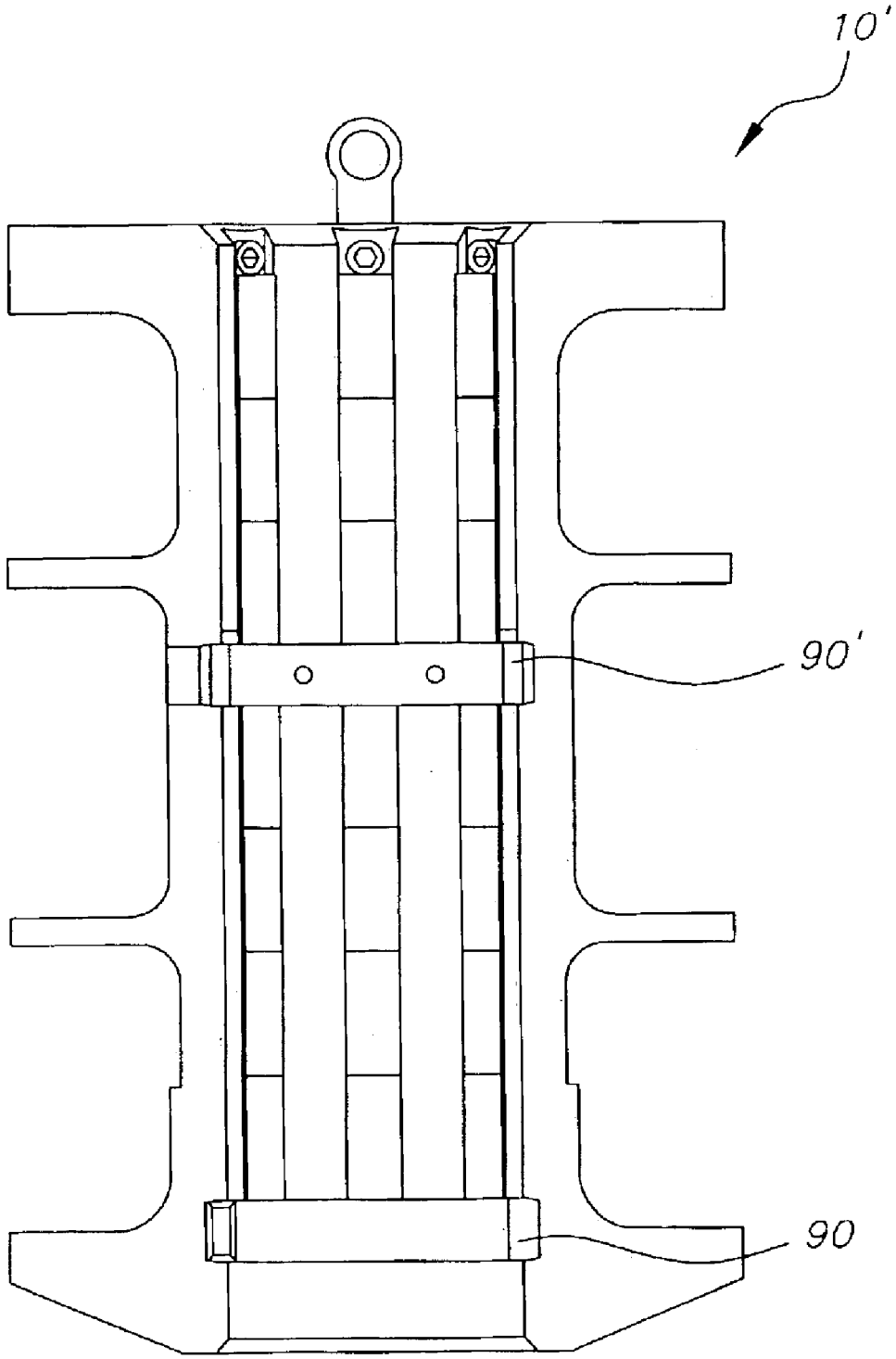
FIG. 8 is a front elevational view of a power slip segment the load ring in accordance with one embodiment of the present invention installed in an insert carrier of a power slip system.
Figure 7B:
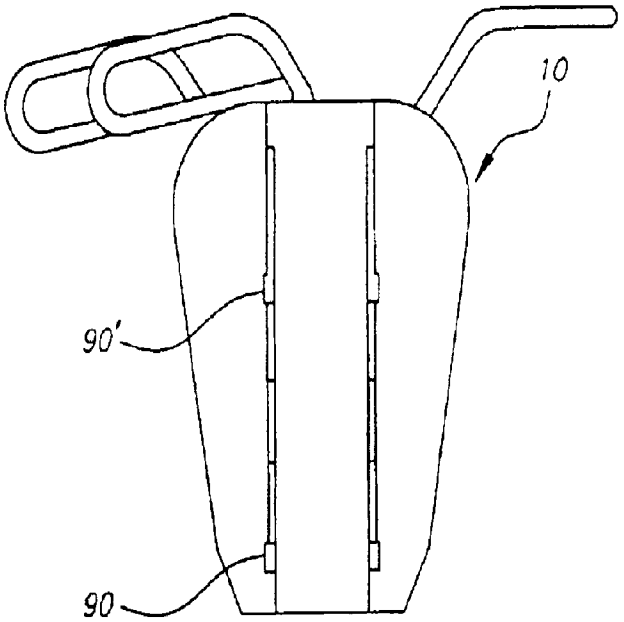
Figure 7A:
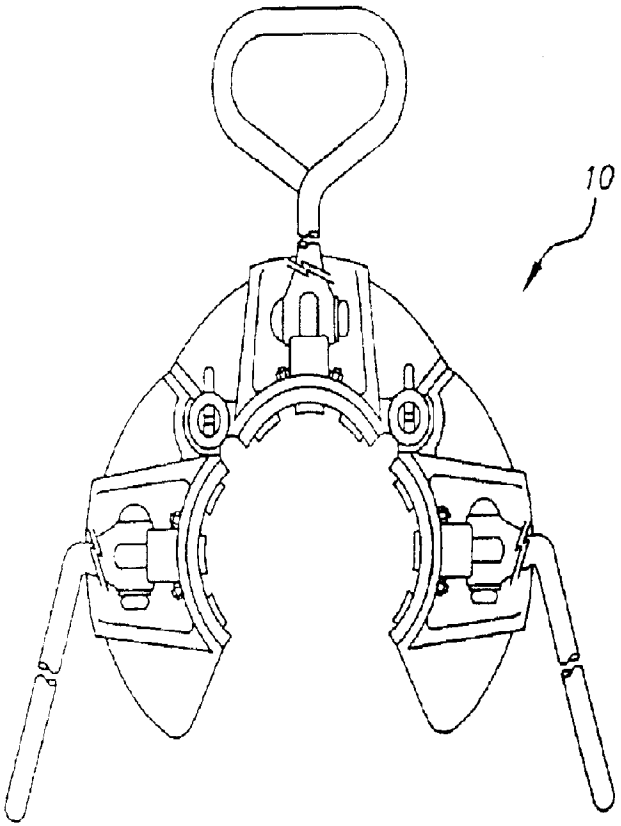

The load ring of the present invention may not only be used in manual slip assemblies 10, as shown in FIGS. 7A and 7B, but may also be used in insert carriers of power slip assemblies 10', as shown in FIG. 8.

It should be understood that the embodiments described and illustrated herein are illustrative only, and are not to be considered as limitations upon the scope of the present invention. Variations and modifications may be made in accordance with the spirit and scope of the present invention. Therefore, the invention is intended to be defined not by the specific features of the preferred embodiments as disclosed, but by the scope of the following claims.

What is claimed is:

1. A rotary slip for supporting a drill string comprising:

a plurality of slip segments connected to define an opening for insertion of the drill string, wherein each slip segment comprises a head region, a toe region, and an inner radial surface axially extending between the head and toe regions, and wherein the inner radial surface of each slip segment comprises a circumferential groove;

a plurality of axially aligned drill string gripping inserts attached to each slip segment between the head region and the circumferential groove, wherein each insert comprises a gripping surface for contacting the drill string;

a load ring disposed within the circumferential groove of each slip element, the load ring comprising at least one securing element which is engaged by one of the plurality of axially aligned inserts to secure the load ring within the circumferential groove;

wherein the inner radial surface of each slip segment comprises at least one axial groove extending from the head region to the circumferential groove, such that each axial groove extends into the circumferential groove; and wherein each axial groove has an inner surface, and wherein the inner surface of at least one of the axial grooves of each slip segment comprises a recessed notch.

2. The rotary slip of claim 1, wherein each of the plurality of axially aligned drill string gripping inserts is at least partially disposed within and interlockingly engaged with a corresponding one of the at least one axial grooves.

3. The rotary slip of claim 1, wherein one of the at least one securing elements of each load ring mates with a corresponding one of the axial groove recessed notches.

4. The rotary slip of claim 3, wherein each securing element is substantially flush with the inner surface of the axial groove when the securing element is mated with the corresponding one of the axial groove recessed notches.

5. The rotary slip of claim 3, wherein the one of the plurality of axially aligned inserts that engages the at least one securing element to secure the load ring within the circumferential groove, further secures the securing element within the recessed notch.

6. The rotary slip of claim 1, further comprising at least one secondary fastener designed to secure the load ring within the circumferential groove.

7. The rotary slip of claim 6, wherein the secondary fastener is selected from the group consisting of: cotter pins and threaded bolts.

8. The rotary slip of claim 1, further comprising a second load ring, and wherein the inner radial surface of each slip segment comprises a second circumferential groove, the second load ring disposed within the second circumferential groove of each slip element, the second load ring comprising at least one securing element which is engaged by one of the plurality of axially aligned inserts to secure the second load ring within the second circumferential groove.

9. A rotary slip for supporting a drill string comprising:

a plurality of slip segments connected to define an opening for insertion of the drill string, wherein each slip segment comprises a head region, a toe region, and an inner radial surface axially extending between the head and toe regions, and wherein the inner radial surface of each slip segment comprises a circumferential groove and at least one axial groove extending from the head region to the circumferential groove, such that each axial groove extends into the circumferential groove;

a plurality of axially aligned drill string gripping inserts removably coupled to a corresponding one of the axial grooves, wherein each insert comprises a gripping surface for contacting the drill string;

a load ring disposed within the circumferential groove of each slip element, the load ring comprising at least one securing element which is engaged by one of the plurality of axially aligned inserts to secure the load ring within the circumferential groove; and wherein each axial groove has an inner surface, and wherein the inner surface of at least one of the axial grooves of each slip segment comprises a recessed notch.

10. The rotary slip of claim 9, wherein each of the plurality of axially aligned drill string gripping inserts is at least partially disposed within and interlockingly engaged with a corresponding one of the at least one axial grooves.

11. The rotary slip of claim 9, wherein one of the at least one securing elements of each load ring mates with a corresponding one of the axial groove recessed notches.

12. The rotary slip of claim 11, wherein each securing element is substantially flush with the inner surface of the axial groove when the securing element is mated with the corresponding one of the axial groove recessed notches.

13. The rotary slip of claim 11, wherein the one of the plurality of axially aligned inserts that engages the at least one securing element to secure the load ring within the circumferential groove, further secures the securing element within the recessed notch.

14. The rotary slip of claim 9, further comprising at least one secondary fastener designed to secure the load ring within the circumferential groove.

15. The rotary slip of claim 14, wherein the secondary fastener is selected from the group consisting of: cotter pins and threaded bolts.

16. The rotary slip of claim 9, further comprising a second load ring, and wherein the inner radial surface of each slip segment comprises a second circumferential groove, the second load ring disposed within the second circumferential groove of each slip element, the second load ring comprising at least one securing element which is engaged by one of the plurality of axially aligned inserts to secure the second load ring within the second circumferential groove.

17. A rotary slip for supporting a drill string comprising:

a plurality of slip segments connected to define an opening for insertion of the drill string, wherein each slip segment comprises a head region, a toe region, and an inner radial surface axially extending between the head and toe regions, and wherein the inner radial surface of each slip segment comprises a circumferential groove and at least one axial groove extending from the head region to the circumferential groove, such that each axial groove extends into the circumferential groove, and wherein the circumferential groove comprises a upper, lower and inner surfaces;

a plurality of axially aligned drill string gripping inserts removably coupled to a corresponding one of the axial grooves, wherein each insert comprises a gripping surface for contacting the drill string;

a load ring having inner, outer, top and lower surfaces, wherein the load ring is disposed within the circumferential groove of each slip element, such that the lower, outer and top surfaces of the load ring fit, respectively, within the lower, inner and upper surfaces of the circumferential groove; and at least one tab protruding from the top surface of the load ring, wherein each tab comprises a front surface and a back surface, such that the front surface of each tab is engaged by one of the plurality of axially aligned inserts to secure the load ring within the circumferential groove, wherein the inner surface of at least one of the axial grooves of each slip segment comprises a recessed notch.

18. The rotary slip of claim 17, wherein each of the plurality of axially aligned drill string gripping inserts is at least partially disposed within and interlockingly engaged with a corresponding one of the at least one axial grooves.

19. The rotary slip of claim 17, wherein one of the at least one load ring tabs mates with a corresponding one of the axial groove recessed notches, such that the front surface of each load ring tab is substantially flush with the inner surface of the axial groove when the load ring tab is mated with the corresponding one of the axial groove recessed notches and wherein the one of the plurality of axially aligned inserts that engages the front surface of the tab to secure the load ring within the circumferential groove, further secures the tab within the recessed notch.

20. The rotary slip of claim 17, further comprising at least one secondary fastener designed to secure the load ring within the circumferential groove.

21. The rotary slip of claim 20, wherein the secondary fastener is selected from the group consisting of: cotter pins and threaded bolts.

22. The rotary slip of claim 17, further comprising a second load ring, and wherein the inner radial surface of each slip segment comprises a second circumferential groove, the second load ring disposed within the second circumferential groove of each slip element, the second load ring comprising at least one securing element which engages one of the plurality of axially aligned inserts to secure the second load ring within the second circumferential groove.

* * * * *

UNITED STATES PATENT AND TRADEMARK OFFICE

CERTIFICATE OF CORRECTION

PATENT NO. : 6,845,814 B2
DATED : January 25, 2005
INVENTOR(S) : Mason et al.

It is certified that error appears in the above-identified patent and that said Letters Patent is hereby corrected as shown below:

Title page,
Item [56], References Cited, U.S. PATENT DOCUMENTS,
"6,557,641 B2" reference, delete "Sipose" and insert -- Sipos --.

Drawings sheet, consisting of Fig. 7A and Fig. 7B, should be deleted and replaced with the drawing sheet, consisting of Fig. 7A and Fig. 7B, as shown on the attached page.

Column 8,
Line 57, delete "a".

Signed and Sealed this

Twenty-third Day of May, 2006

JON W. DUDAS
*Director of the United States Patent and Trademark Office*

UNITED STATES PATENT AND TRADEMARK OFFICE

CERTIFICATE OF CORRECTION

PATENT NO. : 6,845,814 B2
APPLICATION NO. : 10/336084
DATED : January 25, 2005
INVENTOR(S) : Mason et al.

It is certified that error appears in the above-identified patent and that said Letters Patent is hereby corrected as shown below:

In the Specification

| | |
|---|---|
| Column 3, line 34 | After "cross-sectional",<br>Insert --view-- |
| Column 3, line 45 | Delete "slig",<br>Insert --slip-- |
| Column 3, line 57 | After "segment",<br>Insert --of-- |
| Column 5, line 58 | Delete "with the an",<br>Insert --with an-- |
| Column 6, line 27 | Delete "secure",<br>Insert --securely-- |

Signed and Sealed this

Fourth Day of July, 2006

JON W. DUDAS
*Director of the United States Patent and Trademark Office*